United States Patent [19]

Fischer

[11] Patent Number: 4,601,940

[45] Date of Patent: Jul. 22, 1986

[54] PADDED KNIT FABRIC, PARTICULARLY FOR LINGERIE, AND METHOD OF ITS MANUFACTURE

[76] Inventor: Arwed W. Fischer, Ambergerstrasse 48, 8584 Kemnath-Stadt, Fed. Rep. of Germany

[21] Appl. No.: 531,615

[22] Filed: Sep. 12, 1983

[30] Foreign Application Priority Data

Sep. 11, 1982 [DE] Fed. Rep. of Germany ..... 3233793

[51] Int. Cl.[4] ..... B32B 1/00

[52] U.S. Cl. ..... 428/178; 66/195; 264/258; 428/223; 428/253; 428/246

[58] Field of Search ..... 428/223, 253, 225, 224, 428/284, 178; 66/195; 264/258

[56] References Cited

U.S. PATENT DOCUMENTS 4,389,447 6/1983 Disselbeck et al. ..... 428/223

*Primary Examiner*—James J. Bell

*Attorney, Agent, or Firm*—Frishauf, Holtz, Goodman & Woodward

[57] ABSTRACT

Padded fabric particularly suitable, for example, for padded brassieres is made by knitting, on a tricot or Raschel knitting machine, having at least three guide bars (53,54,55) and two rows (51,51') of spaced needles, inner and outer base fabrics (58,59) which are connected with interknitted filler threads (61) in the form of sinker stitches, extending between the base fabrics, the sinker stitches being bound into and connecting the base fabrics and being interknitted therewith. The filler threads can be suitably selected for bending resistance, and, if a thermoplastic material, mixed for example with cotton, with the thermoplastic material predominating, permitting heat-treatment of the resulting padded material to form, for example, brassiere cups of desired thickness, and hence padding material content.

25 Claims, 8 Drawing Figures

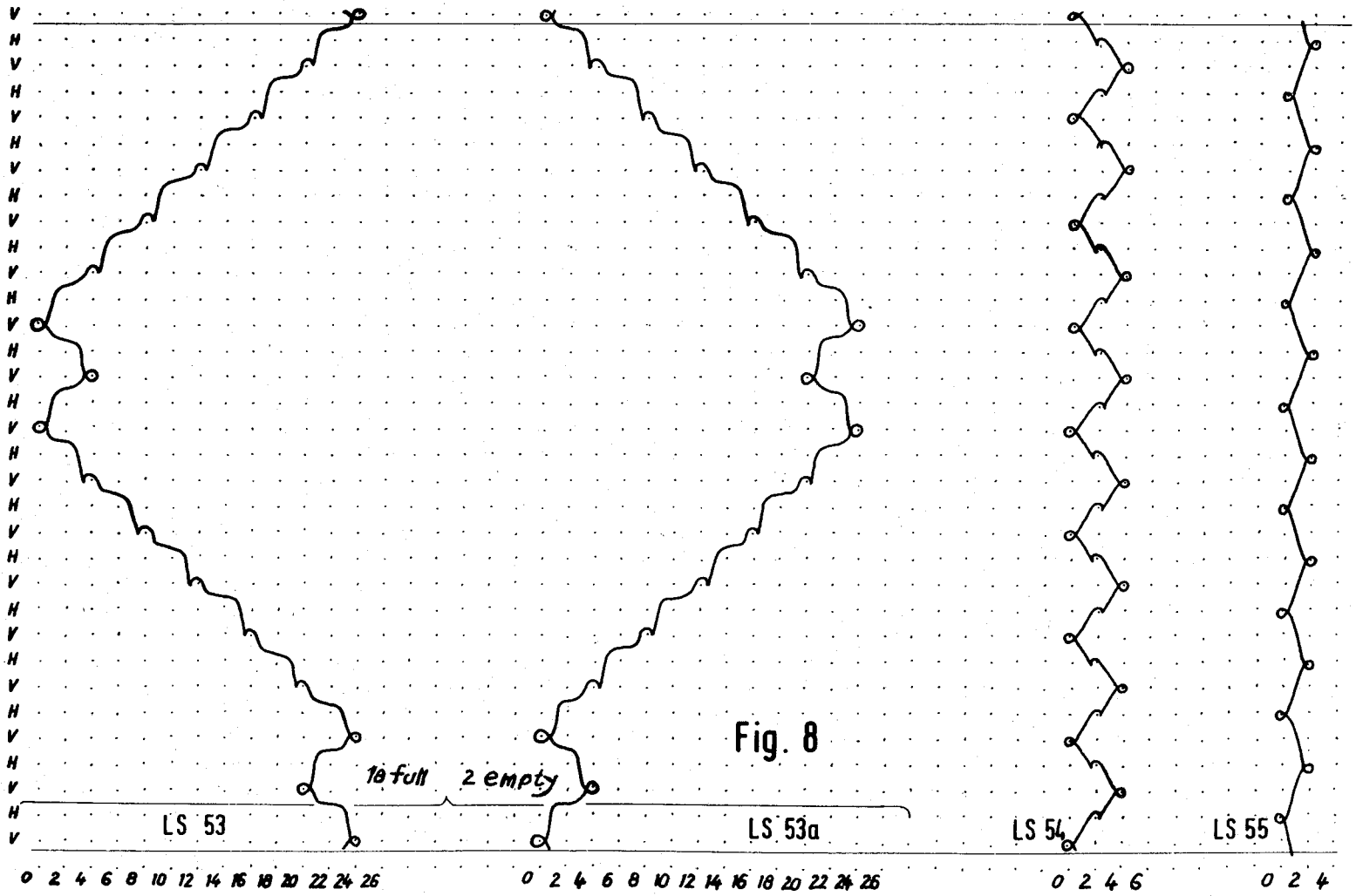
LS 55
LS 54
LS 53a
LS 53
16 full
2 empty
0 2 4 6 8 10 12 14 16 18 20 22 24 26
0 2 4 6
0 2 4
V H V H V H

PADDED KNIT FABRIC, PARTICULARLY FOR LINGERIE, AND METHOD OF ITS MANUFACTURE

The present invention relates to knit fabric and a method of knitting, in which the fabric has outer and inner layers with a filler therebetween to form a padding, and more particularly to such a fabric which is suitable for use as a padded brassiere.

BACKGROUND

Lingerie fabric, and particularly padded brassieres, require textile material which has a substantial volume while, at the same time, it should be soft, pliable, and have a pleasant "feel" or hand on the skin of the wearer. It has been proposed to utilize layered fabric with fiber-fill. An inner layer, which is plain knit, or jersey-knit fabric, is provided, forming the side which is to be adjacent the skin of the user. An outer layer is provided, also made as knit, or jersey-knit material. A textile filler is located between the inner and outer layers. The textile filler then provides the required volume once the fabric is cut and used for the desired intent, for example as a combination girdle, a brassiere, or the like. The filler material, in accordance with some proposals, is made of a fibrous, loose felt which can be connected to the inner and outer layers by adhesives; in some constructions, the padding is adhered only to the inner layer and connected to the outer layer by seaming, or stitching, for example in a quilt pattern.

Connecting the respective layers of such a multi-layer, or laminated fabric by adhesion interferes with free movement of the fibers of the filler material. This decreases the elasticity of the overall laminated fabric and also reduces the breathing capability of the fabric by interfering with passage of air through the complete, laminated fabric.

In constructions in which the filler is adhesively connected to only one of the layers, typically the inner layer, it is necessary to connect the inner and outer layers by stitching. Such stitching or sewing must be carried out with substantial care since, at the same time, the inner and outer layer as well as the filler are connected by the seams or stitches.

THE INVENTION

It is an object to provide a padded fabric, particularly suitable for lingerie use, and especially for padded brassieres and the like, in which the textile material has substantial volume, which is free of adhesives, which can have high elasticity and is easily made, as well as cut and shaped to form a finished lingerie product.

Briefly, in accordance with the invention, a multi-layer fabric is provided which has a tricot knit outer fabric layer, a tricot knit inner fabric layer spaced from the outer fabric, and essentially parallel thereto, and a textile filler material in the space between the inner and outer fabric layers. In accordance with the invention, the fabric is made on a tricot or Raschel knitting machine having at least three guide bars and two spaced rows of needles. The inner and the outer fabric layers are knitted on needles of the needle rows to form base fabrics. The filler comprises elongated filler threads knitted in the form of sinker loops extending in the space between the inner and outer base fabric layers knitted by the spaced needle rows. The sinker stitches are bound into the base fabric of the inner and outer layers and connect layers of the base fabric.

The needle rows, or needle lines are spaced from each other by a distance sufficient to permit placement of the thread or yarn which will form the sinker stitches of sufficient length. The thread or yarn elements of the sinker loops will extend at suitable angles to the planes of the knitted and outer fabric layers. The sinker loops are close to each other and, hence, the fabric will have substantial volume or "fill" while, however, being completely flexible and pliable.

The tricot fabric is made in a single knitting operation, that is, the inner and outer layers as well as the intermediate loops or stitches are made together, and in one knitting operation.

The resulting fabric can be dyed, finished, and then be ready without further manufacturing steps for cutting and sewing.

Various changes and modifications can be made; for example, at least one of the base fabric layers can be patterned; the two base fabric layers can be knitted with different stitch patterns. For example, and preferably, one of the base fabrics can be knitted to have a higher fill content and, consequently, lower transparency than the stitch pattern forming the base fabric of the other layer. The filler yarn can be placed by two separate warp systems, thereby obtaining a greater density of the filler. The two warp systems can be made by stitch formation with composite yarn laid in opposite direction. This provides a textile material having particularly pleasing appearance.

The wearing comfort of articles made by the material, for example brassieres, can be enhanced by using cotton thread for at least one of the base layers, for example the layer which will provide the knit material at the inside, or the skin-side of the article. The filler, and the outside may be made, for example, of 100% man-made or synthetic fibers, such as, for example, polyester, polyamide (nylon) or the like.

The thread material used for the fillers can be suitably selected, considering the eventual use to which the fabric will be put. Likewise, the length of the filler threads, and thus the space between the base fabrics can be selected according to manufacturing, and use requirements. The density of the filler material, formed by the filler yarns, can be exactly matched to specifications placed by the user. A thicker yarn, a larger number of rows, and a larger racking from needle row, or needle line to needle row or needle line will result in higher density of the filler. Use of a further guide bar, which places threads on both needle rows or lines also increases the resulting fabric density.

Fabric which is to have particularly high elasticity in the filler, preferably, uses filler threads of substantial bend resistance, or longitudinal compression strengths. Monofilamentary synthetic threads are particularly suitable. It is, of course, also possible to make the fabric of 100% cotton, or to use for the fillers, or one or the other of the base fabrics cotton alone, or another natural fiber. Fabric which is particularly elastic can be made by utilizing for the threads of one, or both of the base fabrics, an elastic thread, known under the trade name "Spandex," or "Elasthan".

The filler yarns which extend between the base fabrics or base layers are stressed in longitudinal compression, or bending if the inner and outer layers of the fabric are compressed towards each other. This is in contrast to the force relationships in laminated materials of the prior art, in which the individual fibers or threads of the felted or fiberfill material extend essentially parallel to the major extent of the inner and outer base fabrics, with undulations or wave positions. Lingerie, particularly brassieres made with the fabric of the present invention, thus has a substantially better capability of breathing, and air passage; further, since the filler threads are stressed, upon compression of the material, under bending, the material will have a substantially better resistance to crushing and places a higher elastic resistance to crushing forces. The bending or crushing resistance can be controlled or selected by suitable choice of the density and yarn size, that is, the proximity of one thread to the other of the filler material, as well as the particular material used for the filler. The characteristics of the material thus can be varied over a wide range, as selected, by suitable selection of the size and characteristics of yarn, as well known.

Using two guide bars for the base layer forming the outer layer of the fabric results in tricot fabric which is very compact and tight. It resists stretching. The fabric can utilize primarily, or essentially, thermoplastic yarns. By heat treatment of the cut and sewn final article, it is thus possible to mold the fabric into a final form, for example, to shape brassiere cups.

DRAWINGS

FIGS. 3 to 8 show six different fabric and stitch patterns and arrangements for tricot fabric suitable for lingerie, and especially for padded brassieres.

DETAILED DESCRIPTION

Figure 2:
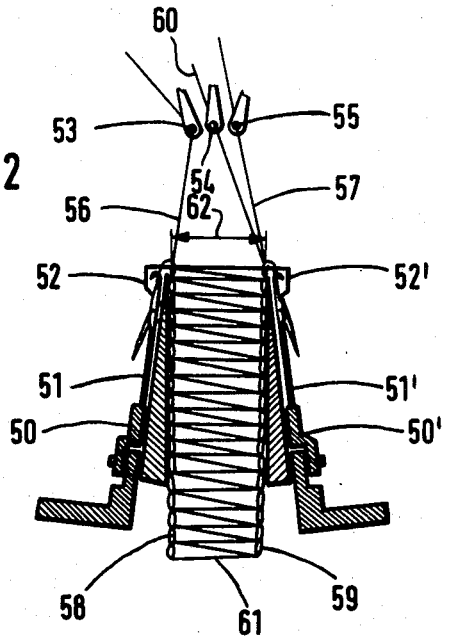
FIG. 2 is a highly schematic side view, partly in section, of a Raschel knitting machine to manufacture the fabric; the view is enlarged, and the cross-section of the fabric material is expanded for better understanding.

The fabrics shown, schematically, in FIGS. 3 to 8, based on the respective stitch formation and yarn laying patterns are all made on a Raschel machine having two needle bars. The invention will be described with specific reference to padded fabric, especially suitable for padded brassieres. FIG. 2, schematically, illustrates those components of a well-known Raschel tricot knitting machine which are necessary for an understanding of the present invention.

Two needle bars 50,50' carry respective needles in needle rows 51,51'. The needles are standard Raschel latch needles, guided within needle slots of a knock-over bar, or a needle bed plate 52, as well known. In a Raschel machine, the needle bed plate is, at the same time, the knock-over line for the formation of the new stitch row. The fabric in accordance with the present invention, thus, can be made on standard industrially available machines without essential modification thereof.

The Raschel machine has at least three guide bars 53,54,55. A larger number of guide bars may be used, for example in order to provide one of the base layers with a complex pattern, or in order to permit a plurality of feeds of filler yarn, as will be described in detail below.

In the specification and claims, reference will be made to "inner" and "outer" base fabrics or layers; the designation "inner" and "outer" is, of course, interchangeable, and is utilized in the description merely for clarity of explanation. Which one is the inner or outer layer in a finished article will depend, entirely, on the use to which the article is to be put. Reference will also be made to the visible or front, and hind or rear side; again, these are only arbitrary designations to facilitate understanding of the invention without limitation on the eventual use of the fabric.

The front guide bar 53 and the rear guide bar 55, each, cooperate with and work with the associated front, or rear needle line, or needle row 51,51', respectively. They form, together with the respective threads or yarns 56,57, a respective base fabric layer. The two base fabric layers are shown at 58,59.

The central guide bar 54 places its yarn 60 from one needle row or line 51 to the other needle line or row 51'. The central guide bar, thus, will form extended, elongated sinker loops. These sinker loops are constituted by the filler threads or yarns, which extend between the spaced base layers 58,59, placed by the respective guide bars 53,55.

The filler threads, which are generally and collectively shown at 61, thus form an elastic, absorbent, air-permeable filler material between the base layers 58,59, forming the inner and outer, or front and rear, or visible and hind fabric layers 58,59, respectively.

The length of the filler threads 61, and hence the thickness of the resulting fabric is determined by the distance shown by the spacing arrow 62 in FIG. 2 of the needle bars, or needle bed plates 52, respectively. The thickness of the fabric or material which is made can be suitably selected and changed by suitable positioning, or changing the distance 62 between the needle bed plates 52,52' carrying the respective needles of the needle rows or lines 51,51'. As can be seen, the possibilities and variety of the materials which can be made is substantial. Fabric can be made which is quite thin, in which the two base layers 58,59 are almost in contact with each other, with only short filler threads 61; it is also possible to make extremely thick padded materials, in which the filler threads 61 have a correspondingly greater length. Any thickness of goods required in lingerie manufacture, and specifically for padded brassieres, can be made in this manner.

The density of the filler thread 61, which will have an effect on the overall filler material, can be controlled and selected as desired, to meet specific requirements of lingerie manufacturers. Using a thicker yarn size, a greater number of rows, and larger racking from needle row to needle row, results in a higher density of the filler material; likewise, use of further central guide bars which place filler yarns, corresponding to the single guide bar which is 54, which is shown, and placing thread on the respective needle rows 51,51' to form the connecting of filler threads also increases the density of the filler structure.

Use of fewer guide bars supplying threads to the needle rows 51,51', a direct path of the yarn from one needle row to the other, that is, a lesser racking, results in a thinner material. Use of a lower number of rows, and thinner threads also results in lesser filler material between the two base fabrics 58,59. Keeping constant the adjustment of the machine and the materials, a Raschel machine of fine cut will thus provide fabric with more filler material than a Raschel machine having a coarser cut.

Each one of the needle rows 51,51' has associated therewith at least one guide bar 53,55. These guide bars remain associated with the particular needle rows and do not apply threads to the oppositely placed needle row. This prevents migration of the filler threads 61 forming the connection between the two base fabrics 58,59 by generating the elongated sinker loops. Such migration might cause the fabric to become loose, or flabby and flat. The sinker loops have no possibility to acquire, subsequently, thread lengths, and thereby increase and thus reduce the thickness of the fabric which is being knitted.

The basic structure, as described, uses three guide bars 53,54,55; guide bar 53 places thread on the front, or visible needle row 51, guide bar 54 places thread on both needle rows 51,51' and guide bar places thread on the rear needle row 51'. This arrangement permits manufacture of plain, unpatterned fabric.

The base fabric which is to form the outside, for example base fabric 58, may be patterned. This may be desired by some converters. Practically unlimited patterning possibilities, well known from tricot knitting, can be used without departing from the method which applies the filler structure, in accordance with the present invention. For example, the stitch formation can be changed; more than one guide bar, for example, with different color threads may be used, and the like.

Similarly, it is possible to use different stitch patterns in the two base fabrics 58,59.

The invention has been described in connection with a single central guide bar 54. More than one such guide bar may be used, each one having its own yarn feed, or warp system associated therewith, and which work together with both of the needle rows 51,51'. Particularly compact tricot fabric which is stretch-resistant can be made, in accordance with a preferred embodiment, by generating the base fabric which will form the outer side of the finished article with two guide bars, and using only a single guide bar, however, to place the filler yarns or threads 61 and to knit the base fabric which will form the inner layer.

The respective guide bars can place threads of the same, or different characteristics or materials. In accordance with the preferred embodiment, the rear, or inner guide bar 55 places cotton thread; the forward or visible guide bar 53, as well as the central guide bar 54, each place polyester thread, or nylon thread. The overall fabric which will then result will have an inner layer, the one which is to be next to the skin of the wearer which is primarily made of cotton—having a soft hand and pleasant to the skin of the wearer. The filler, formed by the filler threads 61, and the base layer 58 forming the outer or visible layer then will consist of 100% polyester, or 100% nylon, respectively.

FIGS. 3 to 8 show six different double-sided tricot fabrics with different yarn placement patterns. The abbreviation "H" illustrates the hind, or rear side; the abbreviation "V", the visible or front side of the respective needle bar 52,52'; the numbers represent the shifting of the guide bars.

The abbreviation "LS" represents the guide bar, associated with the respective reference numeral as shown in FIG. 2. The fabric of FIG. 7 utilizes two central guide bars **54,54*a* and the fabric of FIG. 8 uses two front guide bars 53,53*a***.

Figure 3:
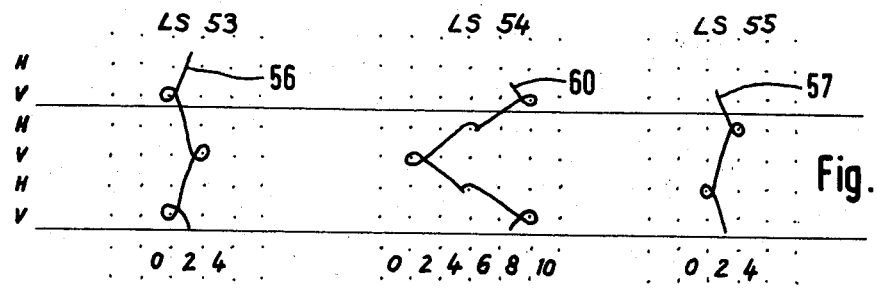

The patterns of FIGS. 3,4,6 and 7 have base fabric layers 58,59 which are knitted by the forward, or visible, or rear or hind guide bars 53,55, respectively. Each one has a left/right tricot stitch pattern which is closed. FIG. 3 shows the basic patterning arrangement.

Figure 4:
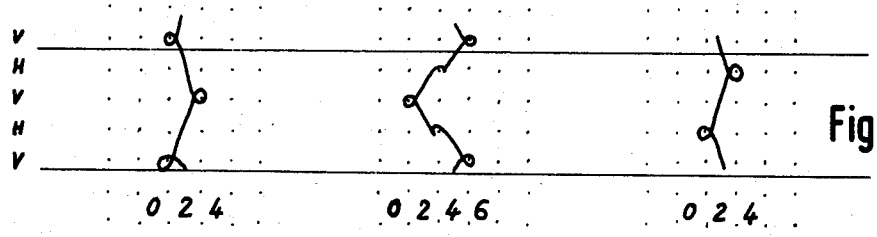

In the embodiment of FIG. 4, the patterning of the central guide bar 54 is foreshortened with respect to that of FIG. 3. This results in a lower filler thread density, and a better bending resistance, since the filler threads 61 extend more at a right angle with respect to the major plane of the base fabrics 58,59.

Figure 6:
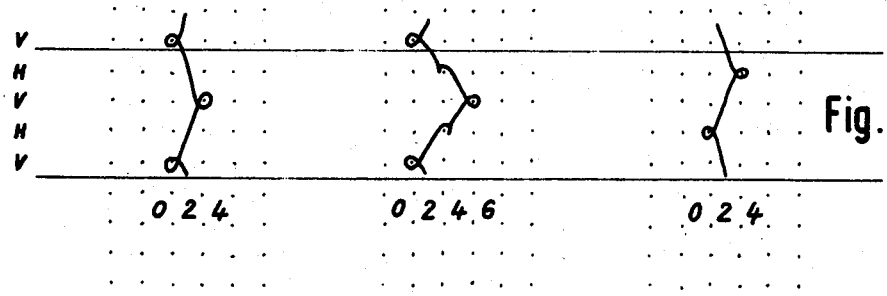

FIG. 4 illustrates another feature: the central guide bar is operated in a direction opposite to that of the forward guide bar 53. In FIG. 6, the pattern shows an arrangement in which the opposite conditions pertain, that is, the central guide bar 54 operates in parallel with respect to that of the forward, or visible, or front guide bar 53, in order to position the stitches straighter, if this is desired for appearance's sake. The arrangement of FIG. 6 is, generally, considered more pleasing.

Figure 5:
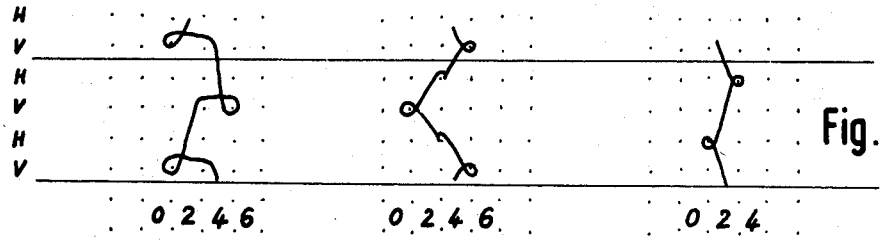

In the embodiment of FIG. 5, the forward guide bar 53 places the yarn over two (left/right body is closed), in order to apply to the front side of the goods more fill and thus obtain a decrease in transparency. Of course, a similar arrangement can be used at the rear or hind side of the goods.

Figure 7:
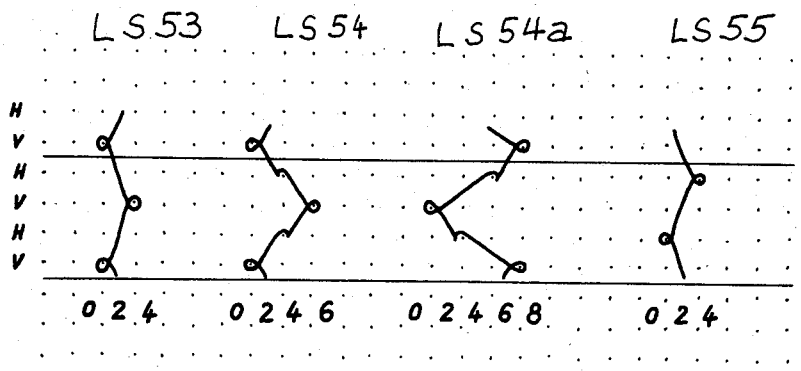

Embodiment of FIG. 7: two central guide bars **54,54*a* are used—in contrast to the embodiments of FIGS. 3–6 which use only a single guide bar 54. As seen in FIG. 7**, the stitches result in threads which are more straight; on the other hand, however, the density of filler threads is greater, and hence more material is being used.

Embodiment of FIG. 8: a single central guide bar 54 and a single rear or hind guide bar 55 is used, in combination with two forward guide bars **53,53*a*. The front or visible base fabric, corresponding to the base fabric 58**, will then have the switch pattern shown, also known as the "Atlas" pattern.

Figure 1:
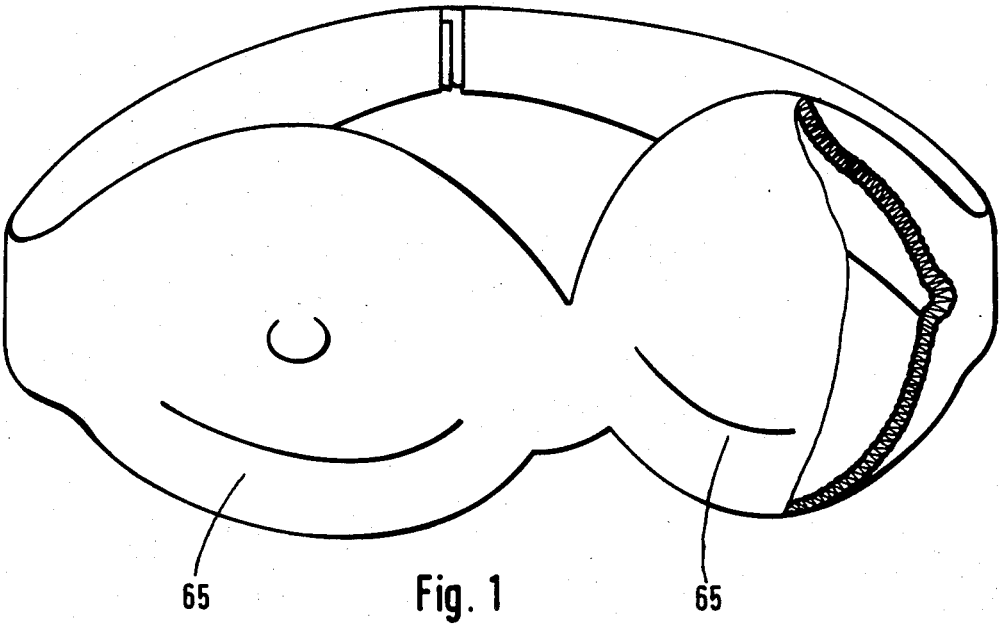
FIG. 1 is a pictorial view, partly in section, of a brassiere utilizing the fabric of the present invention.

The double layer, intermediatly padded tricot fabric permits the manufacture of various types of articles, and is especially adapted to lingerie and particularly to padded brassieres. The fabric can be made primarily of thermoplastic, synthetic yarn material, for example polyester. If mixtures with cotton are used, it is possible to deform, that is, to mold the textile material, provided the cotton proportion does not rise over about 35% (by weight). The filler threads 61 will not, under such heat treatment, lose their volume-enhancing properties and characteristics. It is possible, for example, to make the brassiere shown in FIG. 1 by constructing the cups 65 directly from the textile material described, in which the textile material will retain the thickness required to increase the outer size of the cups.

The respective yarn lays generated by the guide bars may place yarn of characteristics and materials which can be selected in accordance with the eventual use of the material. For example, if the bending resistance is a primary criterion, the filler yarns 61 are, preferably, selected from monofilimentary polyester yarns or nylon yarns. If the fabric, from which the eventual goods are then cut and sewn is to have high elasticity, it is desirable to utilize an elastic yarn, for example "Spandex" for at least one of the base fabric layers 58,59.

Various combinations of yarn can be used and the attached table shows illustrative examples. The attached table uses the European (continental) yarn designation, in which "detex" represents a number which is 10% more than Denier number, e.g., 150 Denier equals 167 dtex.

TABLE

| | | | Examples of Suitable Threads | | | | | |
|---|---|---|---|---|---|---|---|---|
| | | | For Polyester | | | For Polyamide (nylon) | | |
| (a) | Front | LS 53 | dtex | 50 | | dtex | 44 | |
| | Center | LS 54 | dtex | 18 | Monofil | dtex | 22 | Monofil |
| | Rear | LS 55 | dtex | 18 | Monofil | | | |
| (b) | Front | LS 53 | dtex | 50 | | dtex | 44 | |
| | Center | LS 54 | dtex | 50 | | dtex | 44 | |
| | Rear | LS 55 | dtex | 18 | Monofil | dtex | 22 | Monofil |
| (c) | Front | LS 53 | dtex | 33 | | dtex | 33 | |
| | Center | LS 54 | dtex | 33 | | dtex | 33 | Monofil |
| | Rear | LS 55 | dtex | 18 | Monofil | dtex | 22 | |
| (d) | Front | LS 53 | dtex | 33 | Pattern inlay | dtex | 33 | Pattern inlay |
| | Front | LS 53a | dtex | 33 | Pattern inlay | dtex | 33 | Pattern inlay |
| | Center | LS 54 | dtex | 22 | Monofil | dtex | 33 | Monifil |
| | Rear | LS 55 | dtex | 25 | | dtex | 22 | |
| (e) | Front | LS 53 | dtex | 50 | Multifil | dtex | 44 | |
| | Center | LS 54 | dtex | 50 | Multifil | dtex | 33 | Monofil |
| | Rear | LS 55 | Nm | 120 | CO (cotton) | Nm | 120 | CO (cotton) |
| (f) | Front | LS 53 | dtex | 50 | | dtex | 44 | |
| | Center | LS 54 | dtex | 18 | Monofil | dtex | 22 | Monofil |
| | Center | LS 54a | dtex | 18 | Monofil | dtex | 22 | Monofil |
| | Rear | LS 55 | dtex | 25 | Monofil | dtex | 22 | Monofil |
| (g) | Front | LS 53 | | | | dtex | 44 | elastic (Spandex) |
| | Front | LS 53a | | | | dtex | 44 | Polyamide |
| | Center | LS 54 | | | | dtex | 33 | Polyamide (monofil) |
| | Rear | LS 55 | | | | dtex | 44 | Helance |
| (h) | Front | LS 53 | | | | dtex | 44 | elastic (Spandex) |
| | Front | LS 53a | | | | dtex | 44 | nylon |
| | Center | LS 54 | | | | dtex | 33 | nylon (monofil) |
| | Rear | LS 55 | | | | dtex | 33 | elastic (Spandex) |

Various changes and modifications may be made, and features described with any one of the drawings or examples may be used with any of the others, within the scope of the inventive concept.

I claim:

1. Warp, or tricot, or Raschel knitting machine knit padded supple textile fabric, particularly for lingerie, having a knit tricot outer fabric layer (58) of warp, or tricot, or Raschel machine knit yarn material;

a knit tricot inner fabric layer (59) spaced from the outer fabric layer and essentially parallel thereto, of warp, or tricot, or Raschel machine knit yarn material; and a textile yarn filler material (61) located in the space between said outer and inner fabric layers, wherein, in accordance with the invention, the textile yarn filler material comprises filler yarn (61) warp, or tricot, or Raschel machine knit together with the inner and the outer fabric layers, extending in the space between the fabric layers and formed of elongated sinker loops which are interknit with and bound into the inner and outer knit layers, respectively, and connecting said inner and outer layers together.

2. Fabric according to claim 1, wherein (FIG. 8) at least one (58) of the knit tricot fabric layers (58,59) is patterned.

3. Fabric according to claim 1, wherein the two inner and outer knit tricot fabric layers (58,59) are knit with different stitch formations.

4. Fabric according to claim 3, wherein one of the knit tricot fabric layers is knit with more yarn material in the stitches than the other, to have lesser transparency than the other fabric layer.

5. Fabric according to claim 1, wherein one of the knit tricot fabric layers is knit with cotton yarn.

6. Fabric according to claim 1, wherein the filler yarn comprises monofilamentary synthetic material of high bend resistance.

7. Fabric according to claim 1, wherein the fabric comprises at least about half—by weight—thermoplastic yarn, and the fabric is molded to profiled shape.

8. Warp, or tricot, or Raschel knitting machine knit padded supple textile fabric, particularly for lingerie, having a knit tricot outer fabric layer (58) of warp, or tricot, or Raschel machine knit yarn material;

a knit tricot inner fabric layer (59) spaced from the outer fabric layer and essentially parallel thereof, of warp, or tricot, or Raschel machine knit yarn material; and a textile yarn filler material (61) located in the space between said outer and inner fabric layers, wherein, in accordance with the invention, the fabric is made on a warp, or tricot, or Raschel knitting machine having at least three guide bars (53, 54, 55) and two spaced needle rows or needle lines (51, 51') of knitting needles to form inner and outer fabric layers knitted on the needles of the needle rows or lines to knit inner and outer base fabrics (58, 59), and a filler comprising elongated textile filler yarns (61) knitted in form of sinker loops extending between the spaced base fabrics of the inner and outer fabric layers knitted by said spaced needle rows, said sinker loops being bound into, interknitted with, and connecting the base fabrics of the inner and outer layers.

9. Fabric according to claim 8, wherein (FIG. 8) at least one (58) of the base fabrics is patterned.

10. Fabric according to claim 8, wherein the base fabrics (58,59) are knitted with different stitch formations.

11. Fabric according to claim 10, wherein one of the base fabrics is knitted with more yarn material than the other to have, in the knitted base fabric, lesser transparency than the other.

12. Fabric according to claim 8, wherein (FIG. 7) the sinker loops are placed by two separate guide bars (54,54*a*).

13. Fabric according to claim 12, wherein the guide bars form thread feeds, and supply threads for stitch formation laid in opposite direction.

14. Fabric according to claim 8, wherein one of the base fabrics comprises cotton thread;

the other of the base fabrics, and the filler thread comprises thermoplastic monofilamentary synthetic thread, and at least the filler thread has high bend reistance.

15. Fabric according to claim 8, wherein at least one of the base fabrics is knitted with elastic thread of a first type and an elastic thread of another type.

16. Fabric according to claim 8, wherein the machine has four guide bars, and two (53, 53*a*) of the guide bars supply yarn to one of the one needle rows or lines, so that one of the fabric layers will be knitted with yarn from two guide bars (53, 53*a*).

17. Method of making a supple textile padded fabric, particularly for lingerie, having:

a knit tricot outer fabric layer (58) of knit yarn material;

a knit tricot inner fabric layer (59) spaced from the outer fabric layer and essentially parallel thereto, of knit yarn material; and a textile yarn filler material (61) located in the space between said outer and inner fabric layers, comprising the steps of:

knitting, on a tricot or Raschel knitting machine, having two spaced needle rows or lines (51, 51′) and at least three guide bars (53, 54, 55):

(a) an outer base tricot fabric layer (58) on the needles of the first row (51);

(b) an inner base tricot fabric layer (59) on the needles of a second row (51′);

(c) elongated sinker loops, with connecting or filler yarn (61), the yarn (61) of said sinker loops extending between the knit base fabric layers, knitted by the spaced needle rows (51, 51′), connecting said base fabric layers, and being bound thereinto, and interknit therewith.

18. Method according to claim 17, wherein the step (c) comprises forming said sinker loops to position the filler yarn (61) in a direction which extends in the space between the base fabric layers (58, 59) and in which the yarn forms predetermined angles with respect to the major planes of said base fabric layers.

19. Method according to claim 17, wherein the knitting stitches during knitting of the respective base fabric layers, as set forth in steps (a) and (b) are different.

20. Method according to claim 19, wherein the knitting stitches of steps (a) and (b) form one of the base fabric layers with more yarn and hence lesser transparency that the stitches forming the other one of the base fabrics.

21. Method according to claim 17, wherein the step (c) of forming elongated sinker loops comprises knitting the filler yarn (61) by separate warp systems or yarn feeds supplied by separate guide bars (54,54*a*).

22. Method according to claim 21, wherein the knitting step comprises forming stitches with composite yarn laid in opposite direction.

23. Method according to claim 17, wherein the yarn forming the fabric—by weight—is constituted primarily by thermoplastic material;

and including the further step of heat-treating the fabric to provide a profiled shape thereto.

24. Method according to claim 23, to make brassiere cups, comprising the step of deforming the fabric into cup-shape under influence of heat.

25. Method according to claim 17, wherein at least one of the steps (a) and (b) of knitting at least one of the base fabric layers comprises knitting said at least one base tricot fabric layer with yarn supplied from two guide bars (53, 53*a*) to form said at least one base fabric layer in patterned configuration.

* * * * *